US008474109B2

(12) United States Patent
Takazawa et al.

(10) Patent No.: US 8,474,109 B2
(45) Date of Patent: Jul. 2, 2013

(54) SLIDER ASSEMBLY

(75) Inventors: Shigeyoshi Takazawa, Irvine, CA (US); Albert E. Barrows, La Mirada, CA (US); John B. Sears, Sacramento, CA (US)

(73) Assignee: YKK Corporation (JP)

( * ) Notice: Subject to any disclaimer, the term of this patent is extended or adjusted under 35 U.S.C. 154(b) by 170 days.

(21) Appl. No.: 12/718,447

(22) Filed: Mar. 5, 2010

(65) Prior Publication Data

US 2011/0214261 A1 Sep. 8, 2011

(51) Int. Cl.
*A44B 19/26* (2006.01)

(52) U.S. Cl.
USPC ..... 24/415

(58) Field of Classification Search
USPC ..... 24/415, 418, 421, 433
See application file for complete search history.

(56) References Cited

U.S. PATENT DOCUMENTS

| | | | | |
|---|---|---|---|---|
| 2,569,298 | A * | 9/1951 | Erdmann | 24/421 |
| 2,635,314 | A * | 4/1953 | Firing | 24/421 |
| 3,094,756 | A * | 6/1963 | Scheuerman | 24/421 |
| 3,320,645 | A * | 5/1967 | Burbank | 24/421 |
| 3,813,736 | A * | 6/1974 | Fukuroi | 24/424 |
| 5,884,373 | A * | 3/1999 | Kawamura | 24/421 |
| 6,098,859 | A | 8/2000 | Bortner | |
| 6,314,624 | B1 * | 11/2001 | Lin | 24/421 |
| 6,497,016 | B1 * | 12/2002 | Lin | 24/421 |
| 6,499,200 | B1 * | 12/2002 | Yamagishi et al. | 24/429 |
| 6,918,810 | B1 * | 7/2005 | Brewer, Jr. | 446/369 |
| 7,507,141 | B2 | 3/2009 | Ward et al. | |

FOREIGN PATENT DOCUMENTS

WO WO 03/096831 A1 11/2003

* cited by examiner

*Primary Examiner* — Robert J Sandy
*Assistant Examiner* — David Upchurch
(74) *Attorney, Agent, or Firm* — Kilpatrick Townsend & Stockton LLP

(57) ABSTRACT

Slider assemblies and methods of manufacturing slider assemblies including a slider with a locking feature that cooperates with a plurality of coils of a standard zipper component. In some embodiments, the slider is capable of moving freely along the length of the zipper component when sufficient force is applied to the slider, but is capable of being locked in position when sufficient force is no longer applied to the slider. In certain embodiments, the locking feature is generally M-shaped. In some embodiments, the sliders are formed using injection molding techniques.

12 Claims, 12 Drawing Sheets

SLIDER ASSEMBLY

FIELD OF THE INVENTION

The invention generally relates to slider assemblies configured to cooperate with the coils of zipper components, the slider assemblies capable of being locked into position with respect to the zipper component.

BACKGROUND OF THE INVENTION

Items such as backpacks typically include a variety of different straps, buckles and/or harnesses. For example, some backpacks have two shoulder straps and one or more sternum straps, where the one or more sternum straps is approximately perpendicular to the shoulder straps. In some situations, it may be desirable to join straps or harnesses together. For instance, joining two shoulder straps together by means of a sternum strap can help maintain the position of the backpack on a user and thus provide increased comfort. The joining of two straps together can also help better distribute the load of the backpack.

Sliders that attach to the various straps and help facilitate the joining together of two straps, such as two shoulder straps, are known. For instance, sliders that cooperate with piping or a cord on a shoulder strap have been used to facilitate the joining of two straps together on a backpack. Certain types of current sliders firmly grip the piping/cord to prevent displacement of the slider along the shoulder strap, which makes adjusting the position of the slider along the strap difficult. It is often desirable that the slider be capable of moving up and down along the length of the shoulder straps to help adjust the positioning of the sternum strap. With such assemblies, the slider is free to move upward and downward along the length of the piping/cord so that the position of the slider with respect to the strap is adjustable. However, these types of known sliders are not capable of being locked into a desired position. Other types of sliders that cooperate with piping or a cord on a strap are capable of being locked into position, but require the use of a mechanical locking mechanism. Use of a separate mechanical locking mechanism increases production costs, complexity of the component, and makes the component more susceptible to malfunctioning and/or damage.

Thus, there is a need for improved slider assemblies having sliders that are configured to move smoothly along a predetermined path, such as the length of a strap, when sufficient force is applied to the slider, and that are also capable of being locked into position without the use of an external mechanical locking mechanism.

SUMMARY OF THE INVENTION

In certain embodiments there is provided a slider assembly comprising a slider with a locking feature that cooperates with a plurality of coils of a standard zipper component. In some embodiments, the locking feature is dimensioned to correspond with the dimensions of the coils of the zipper component, as well as the spacing between the coils of the zipper component, such that the slider moves freely along the length of the zipper component when sufficient force is applied to the slider, but is locked in place when sufficient force is no longer applied to the slider. In certain embodiments, the locking feature is generally M-shaped.

Also provided are methods of making a slider assembly comprising a slider with a locking feature, such slider being configured to cooperate with the coils of a zipper component. In some embodiments, such sliders are formed using injection molding techniques.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different features is intended to illustrate like or analogous components.

DETAILED DESCRIPTION OF THE INVENTION

Figure 15:
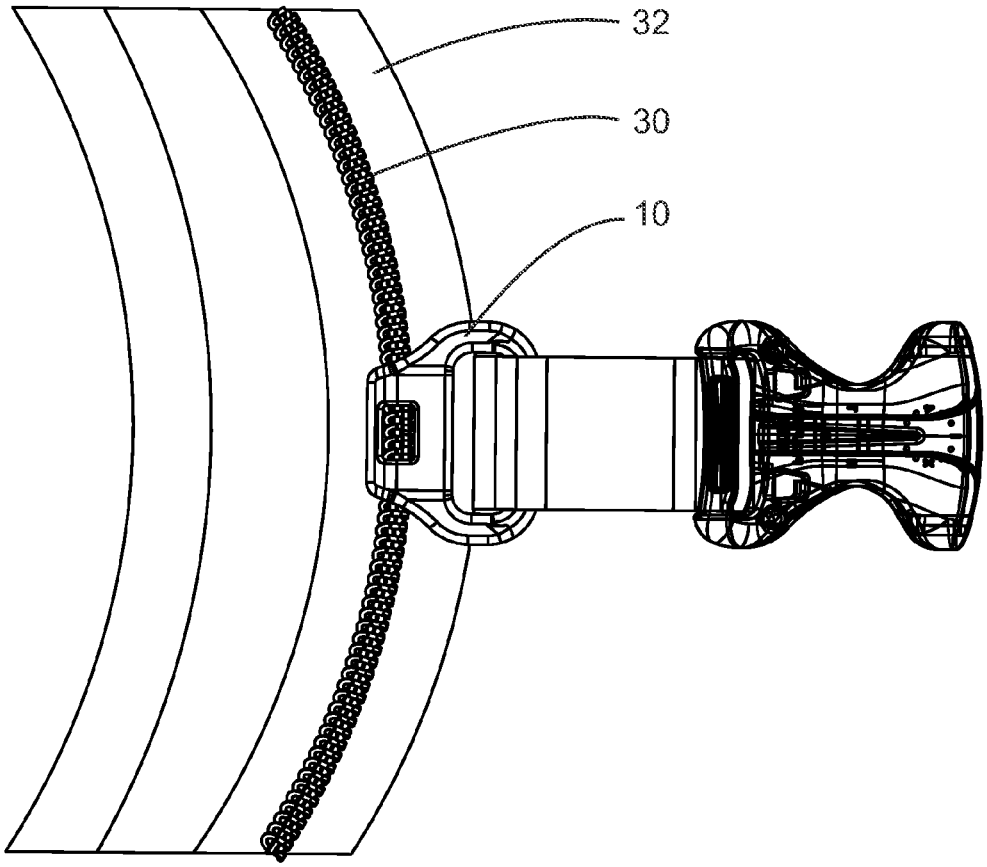
FIG. 15 is a perspective view of a slider assembly according to one aspect of the invention positioned with respect to a backpack.

FIGS. 1-5 illustrate various views of a slider 10 according to one embodiment of the invention. Slider 10 comprises distal portion 12 having an opening 13, where opening 13 is configured to receive a strap, such as a strap connecting two shoulder straps of a backpack or other apparatus (illustrated in FIG. 15). FIG. 15 also shows how slider 10 is positioned in use with respect to a zipper component, which in some embodiments extends at least partially along the length of a strap of a backpack or other apparatus.

Figure 16:
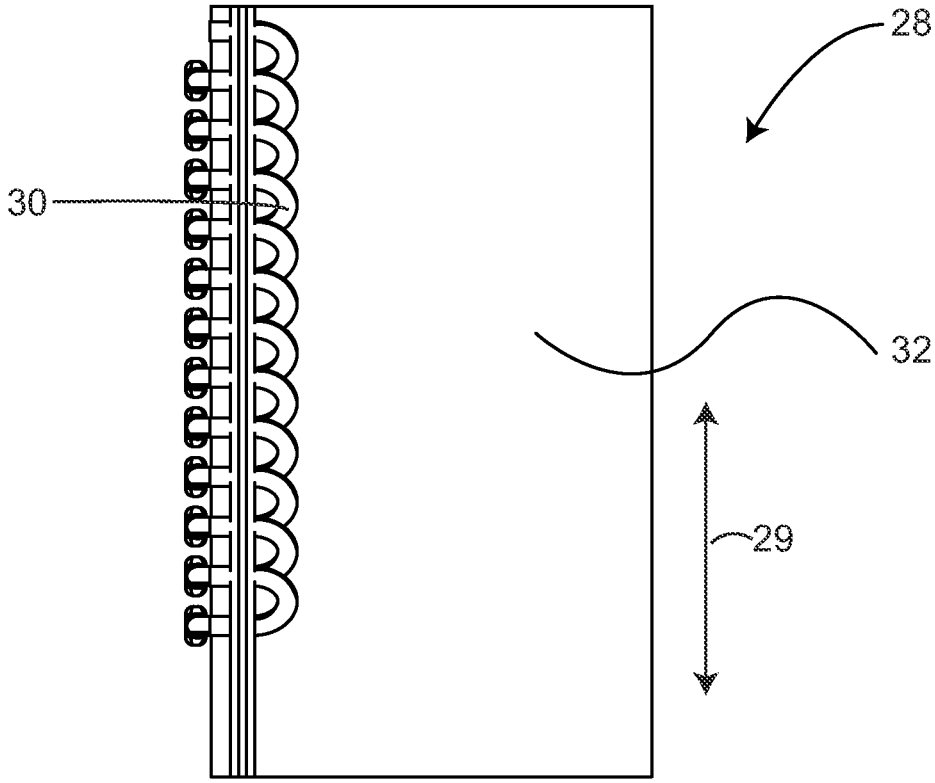
FIG. 16 is a perspective view of a zipper component according to one aspect of the invention.

As shown in FIG. 16, zipper component 28, which may be any standard or custom zipper, includes a tape portion 32 and a plurality of individual coils 30. Zipper component 28 also has a length direction 29. The zipper components 28 used with slider 10 may be of any size, including but not limited to, sizes corresponding to traditional No. 5 or No. 10 zippers. Zipper component 28 may be a plastic zipper or a metal zipper, or made of any other suitable material.

As shown in FIGS. 1-5, slider 10 comprises a locking feature 14 positioned at least partially within a channel 20 of the slider 10. Slider 10 also comprises a lower lip 22 and an upper lip 24 that together define an opening 26. Opening 26 is dimensioned to accommodate the tape portion 32 of zipper component 28, while channel 20 is dimensioned to receive a plurality of coils 30 of zipper component 28.

Figure 1:
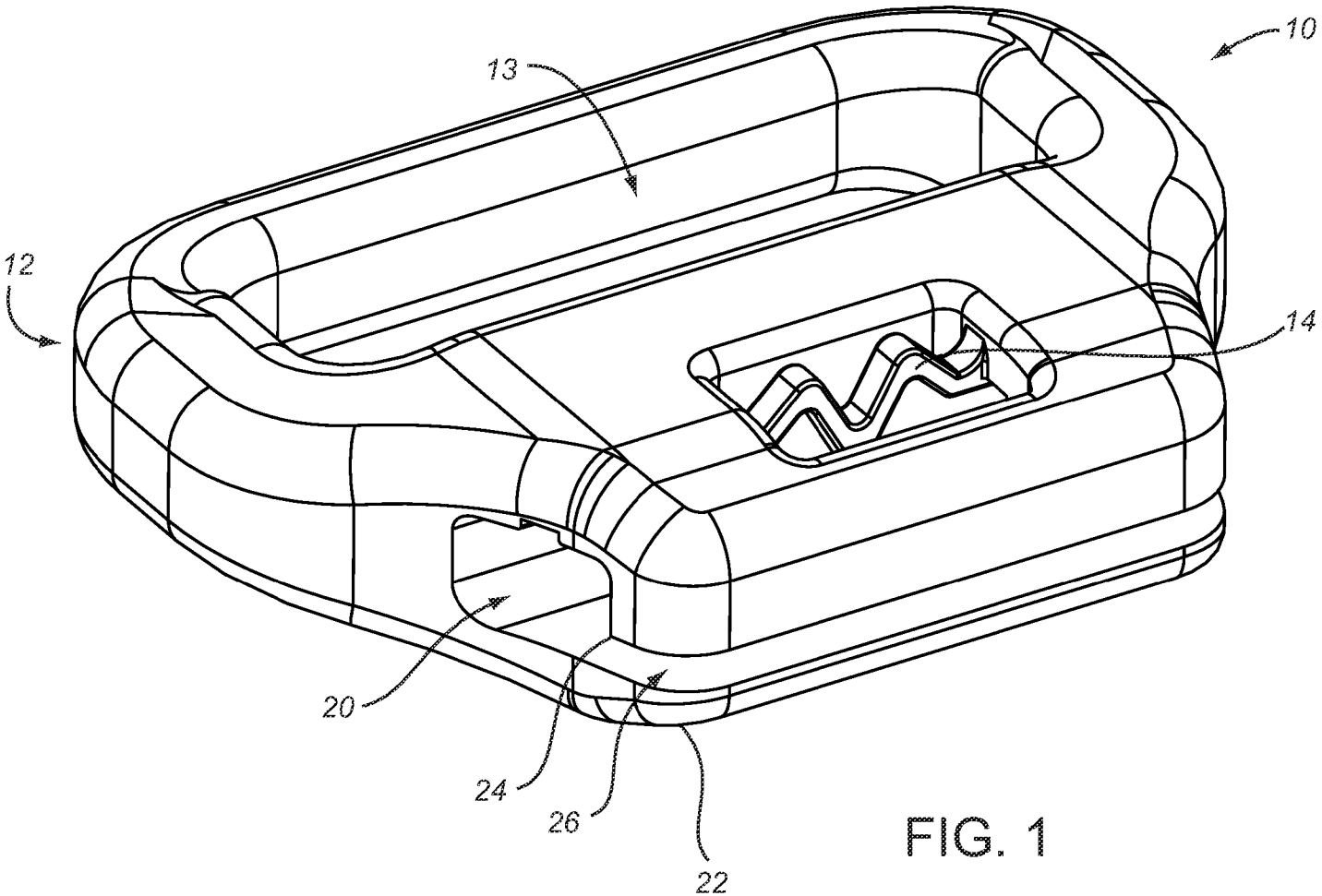
FIG. 1 is a top perspective view of a slider according to one aspect of the invention.
Figure 2A:
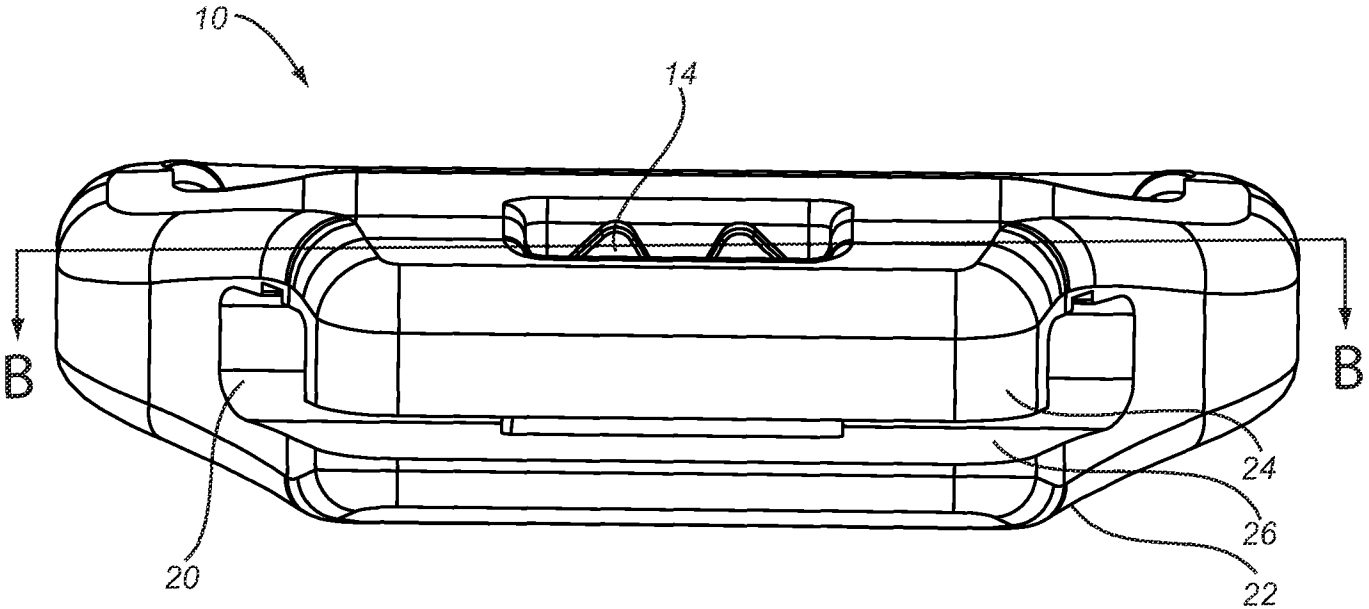
FIG. 2A is a front perspective view of the slider of FIG. 1.
Figure 2B:
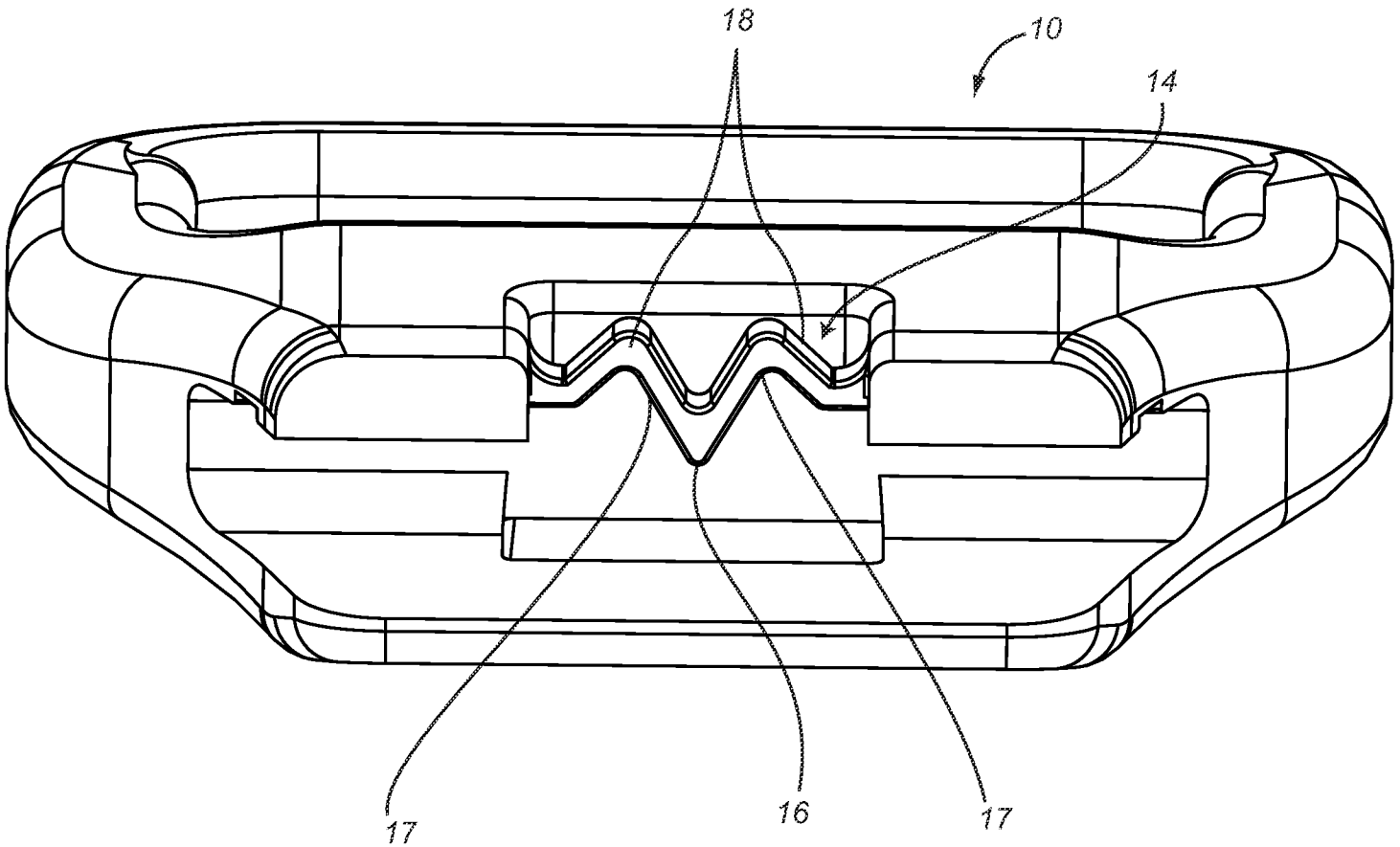
FIG. 2B is a cross sectional view of the slider of FIG. 2A, taken along the line B-B.
Figure 3:
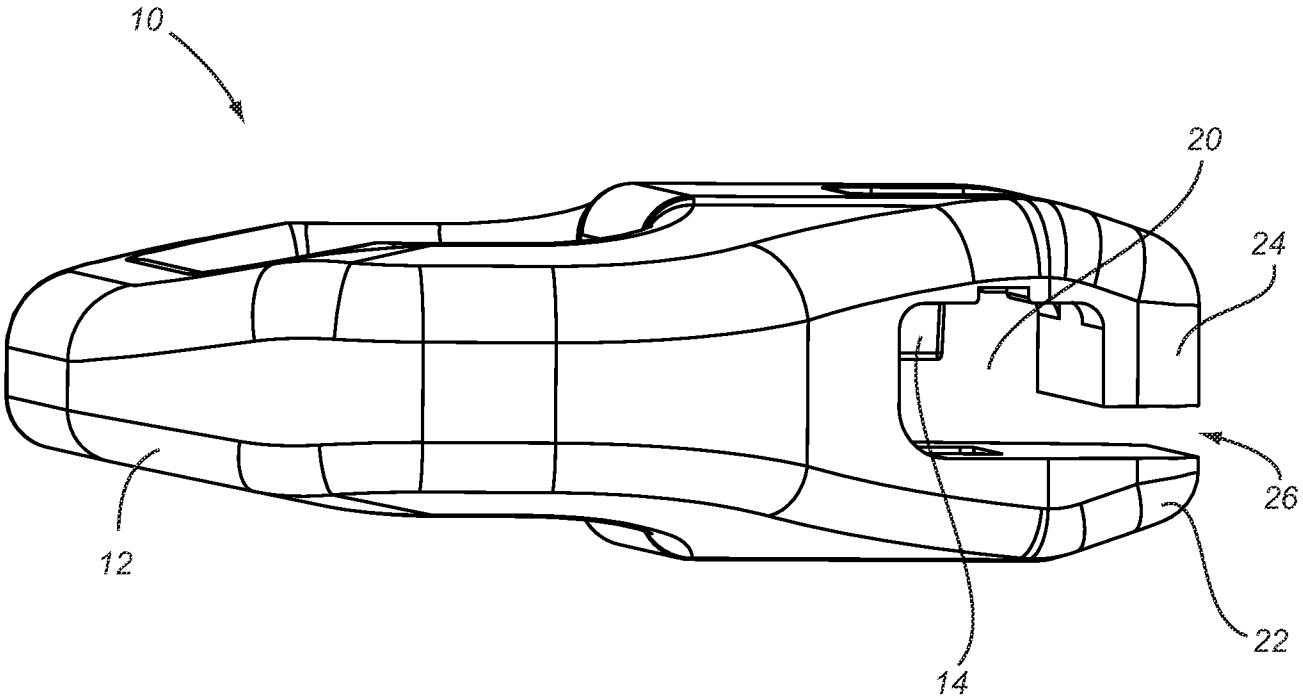
FIG. 3 is a side view of the slider of FIG. 1.
Figure 4:
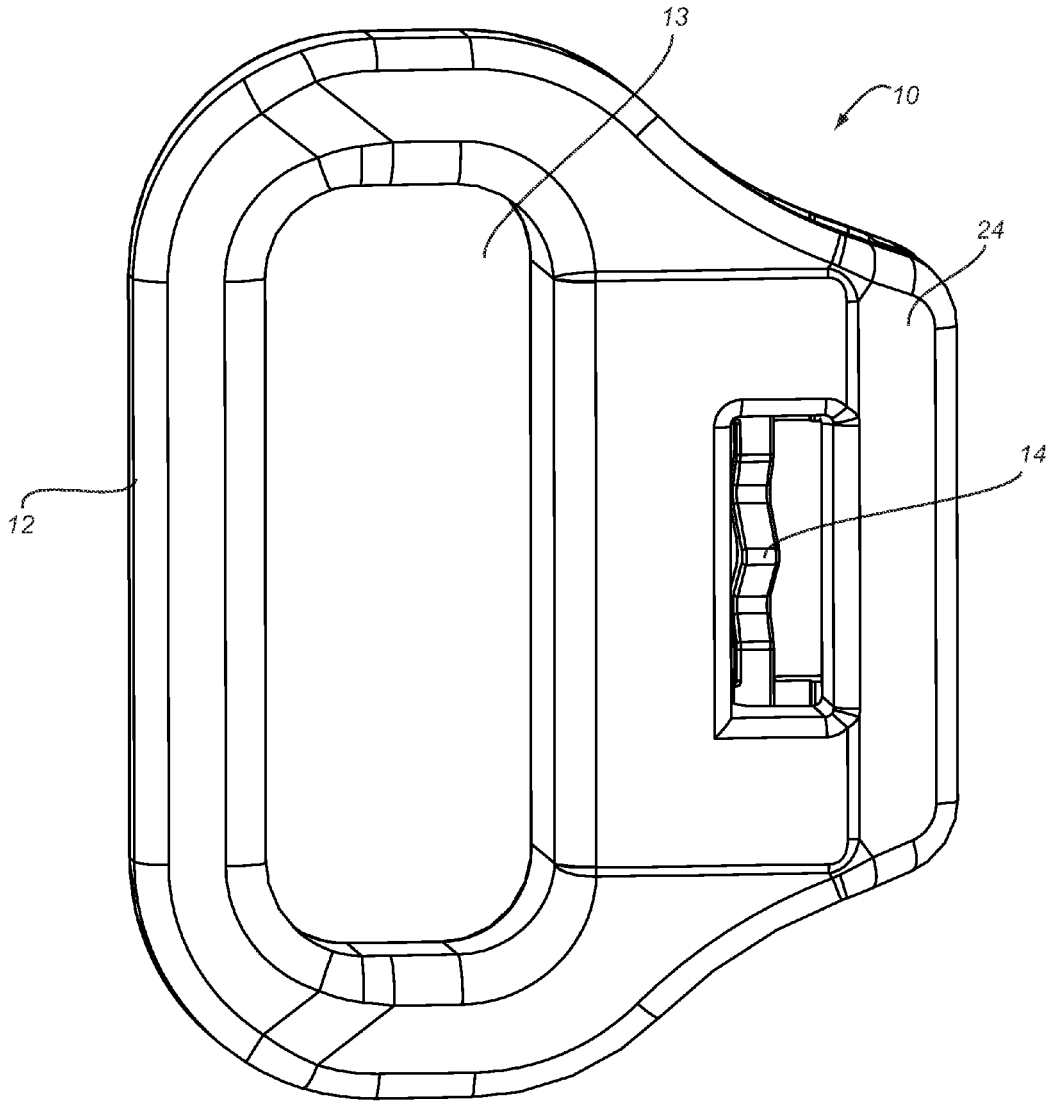
FIG. 4 is a top view of the slider of FIG. 1.
Figure 5:
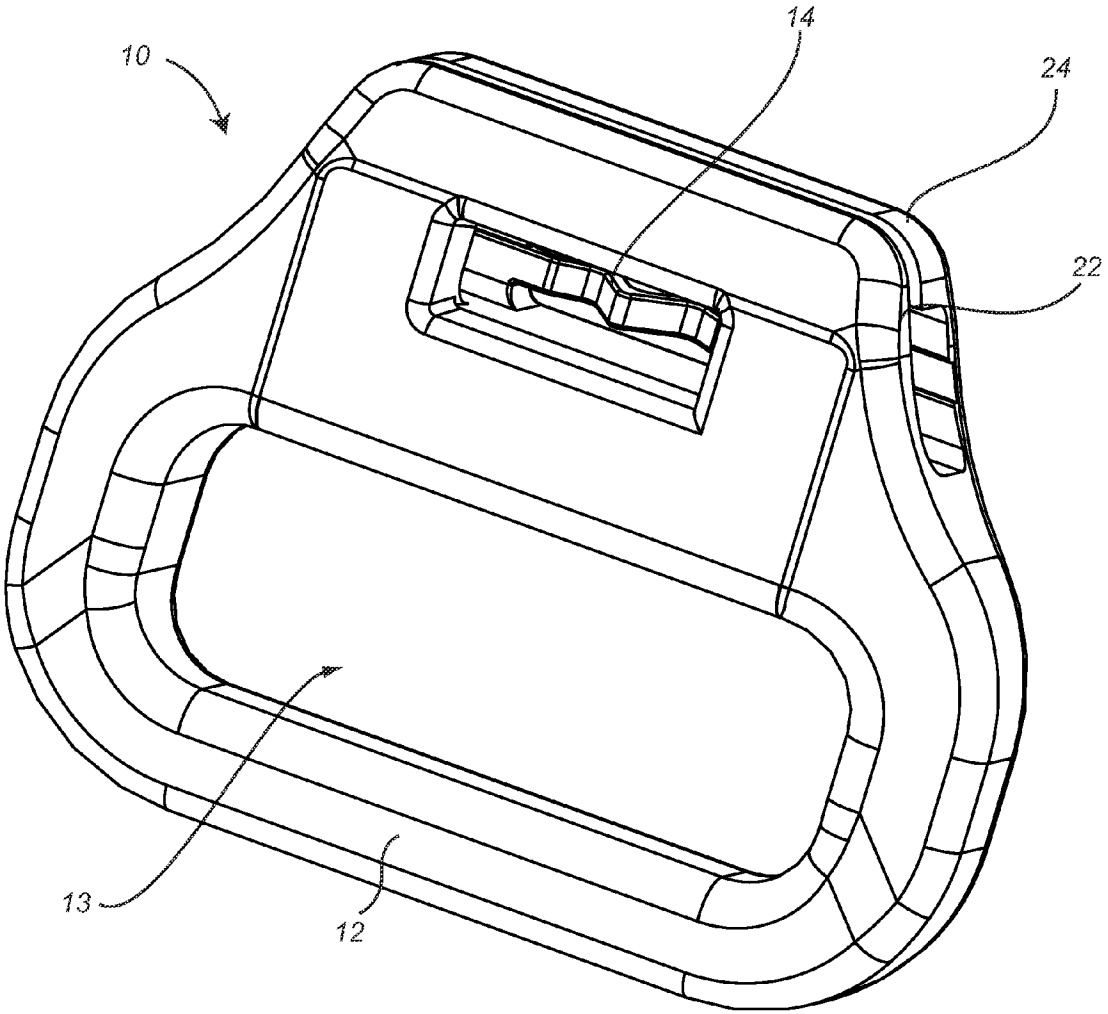
FIG. 5 is a bottom perspective view of the slider of FIG. 1.
Figure 7:
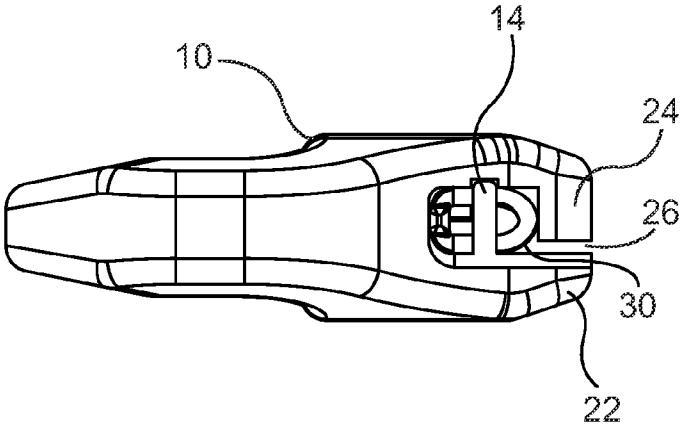
FIG. 7 is a cross sectional view of the slider assembly of FIG. 6, taken along the line A-A.

FIG. 2B is a cross sectional view of slider 10 taken along the line B-B of FIG. 2A. Locking feature 14 is shaped and sized to cooperate with the coils 30 of zipper component 28.

Specifically, locking feature 14 is configured so that when sufficient force is applied to slider 10 in the length direction 29, movement of locking feature 14 along coils 30 of zipper component 28 is unrestricted. In this way, when sufficient force is applied to slider 10, slider 10 moves along the length of zipper component 28 in the length direction 29. Locking feature 14 is also configured so that when sufficient force is no longer applied to slider 10, locking feature 14 is locked in place and movement of slider 10 in the length direction 29 of zipper component 28 is restricted. Locking feature 14 is further configured so that it does not damage coils 30 as slider 10 slides along the length of the zipper component 28. Locking feature 14 is also configured so that locking feature 14 does not contact the tape portion 32 of zipper component 28 when the coils 30 of zipper component 28 are received within channel 20 of slider 10.

Figure 8:
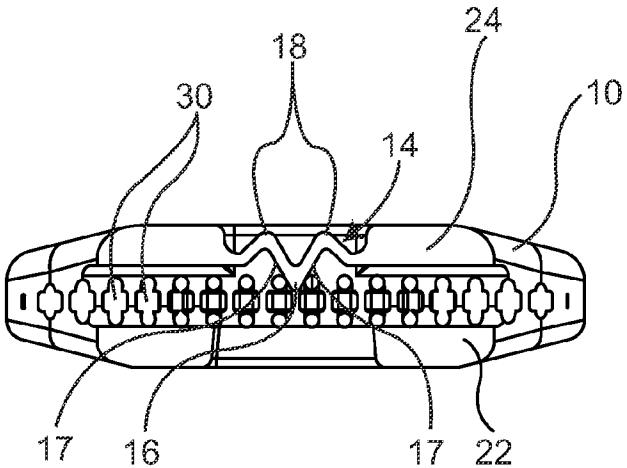
FIG. 8 is a cross sectional view of the slider assembly of FIG. 6, taken along the line B-B.
Figure 6:
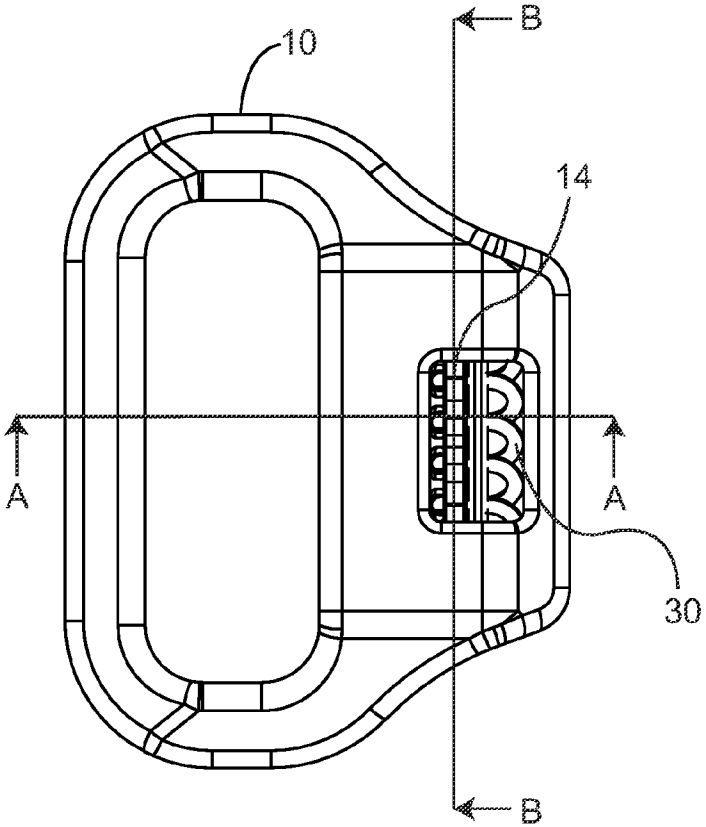
FIG. 6 is a top view of a slider assembly illustrating a slider positioned with respect to the coils of a zipper component according to certain aspects of the invention.

To achieve the properties described above, locking feature 14 comprises an upper spacer portion 18 and a lower engaging portion 16 and at least one angled portion 17 (FIG. 2B). In certain embodiments, locking feature 14 comprises two angled portions 17, with lower engaging portion 16 being positioned between the two angled portions 17. Lower engaging portion 16 of locking feature 14 is shaped and sized to fit between the individual coils 30 of zipper component 28, as shown in FIG. 8. Angled portion 17 is configured relative to the dimensions of coils 30 of zipper component 28 so that lower engaging portion 16 is capable of traversing along coils 30 when sufficient force is applied in the length direction 29 of zipper component 28.

When sufficient force is no longer applied to slider 10 in the length direction 29 and lower engaging portion 16 of locking feature 14 is seated between coils 30, the friction generated due to the configuration of at least one angled portion 17 relative to coils 30 restricts movement of locking feature 14 and thus restricts movement of slider 10 in the length direction 29 of zipper component 28. In this way, slider 10 is self-locking and does not require the use of a separate mechanical locking mechanism.

In some embodiments, lower engaging portion 16 and a portion of angled portions 17 are the only portions of locking feature 14 that contact coils 30 when the coils 30 of zipper component 28 are received within channel 20 of slider 10. As shown in FIG. 2B, locking feature 14 is generally M-shaped in certain embodiments.

The dimensions of locking feature 14 can be modified depending on the size and shape of the coils 30 of zipper component 28, as well as the amount of space between coils 30, to be used with slider 10. Similarly, the dimensions of locking feature 14 can be modified depending on the desired amount of force that must be applied to slider 10 in order to slide locking feature 14 along coils 30 in the length direction 29 of zipper component 28. For example, to increase the amount of force required to move slider 10 in the length direction 29 along zipper component 28, the slope of angled portions 17 can be increased (i.e., the depth of the M-shape of locking feature 14 is increased) so that there is more friction between angled portion 17 of locking feature 14 and the coils 30. In other embodiments, the dimensions of the locking feature 14 may be adjusted instead of, or in addition to, the shape of the locking feature 14 to vary the amount of force required to move slider 10. Conversely, to decrease the amount of force required to move slider 10 in the length direction 29 of zipper component 28, the slope of angled portions 17 can be decreased (i.e., the depth of the M-shape of locking feature 14 is decreased) so that there is less friction between angled portion 17 of locking feature 14 and the coils 30. Such modifications can be accomplished by changing the tooling used to create locking feature 14.

In some embodiments, slider 10 is made of a relativity strong material having memory that allows slider 10 to revert back to the position into which it was molded. For example, slider 10 may be formed from any suitable polymer, such as acetel or any suitable thermoplastic polymer, although any other suitable material may be used to form slider 10.

Figure 9:
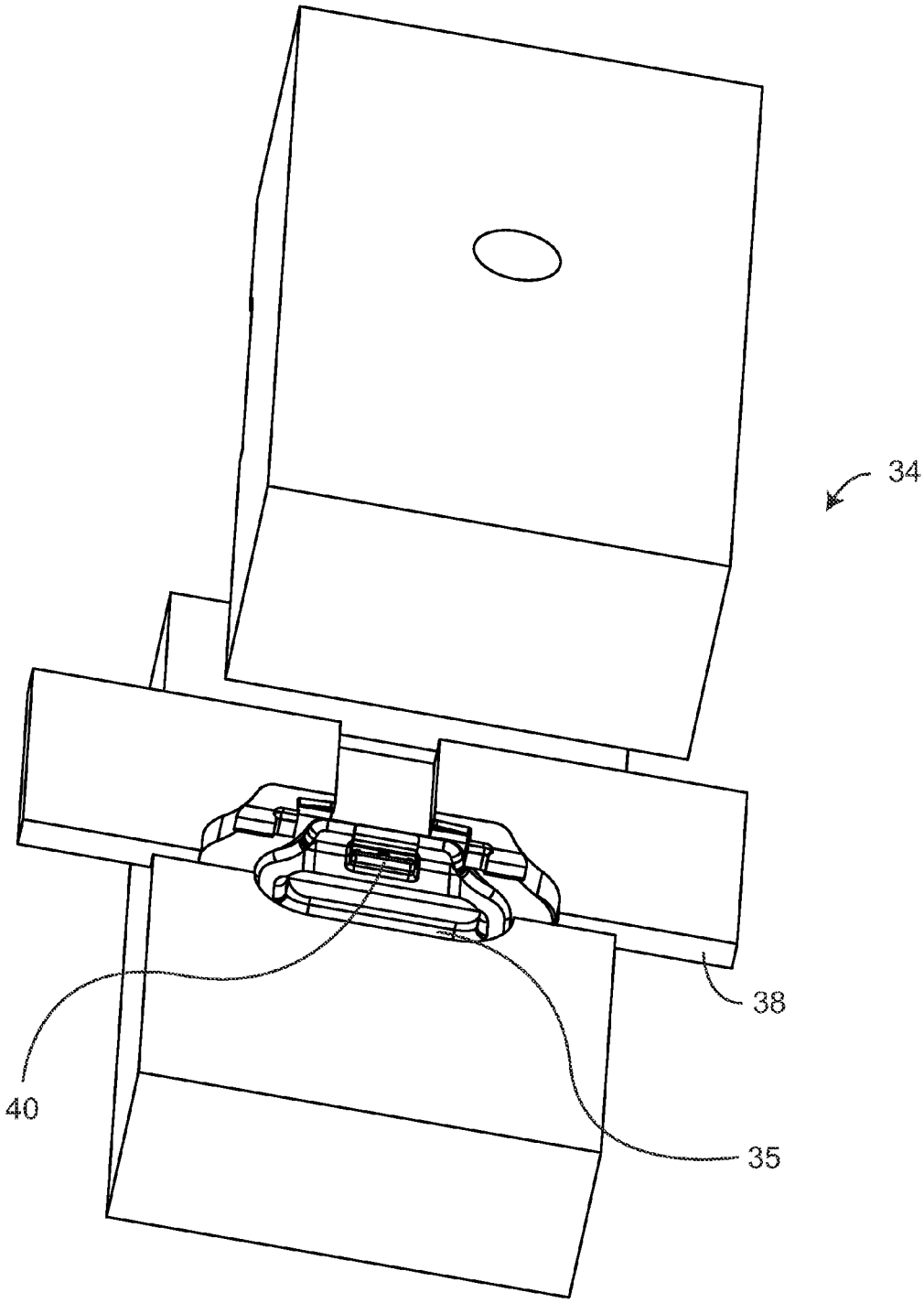
FIG. 9 is a perspective view of a mold used to make a slider according to one aspect of the invention.
Figure 11:
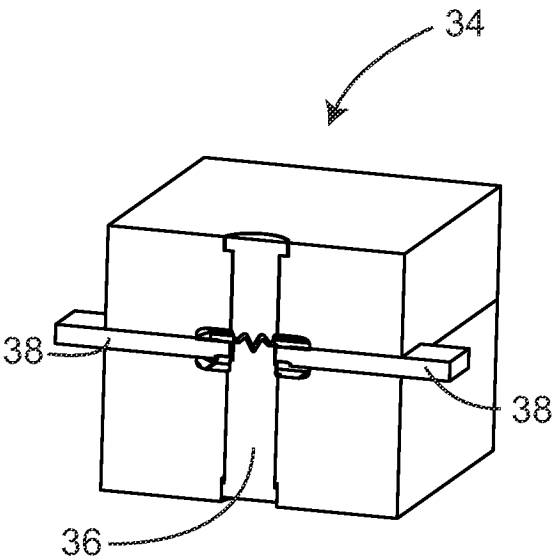
FIGS. 10-14 are perspective views illustrating a process used to create a slider according to one aspect of the invention.
Figure 10:
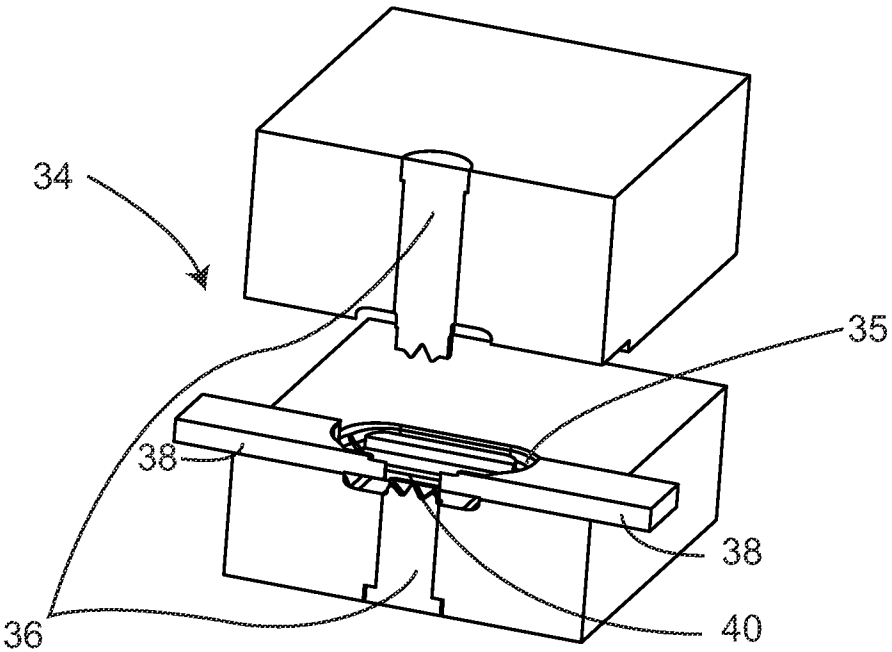

Also provided is a method of manufacturing the sliders 10 described above. In some embodiments, slider 10 is formed using injection molding techniques. FIGS. 9-10 illustrate a suitable mold 34 for molding slider 10 according to one embodiment. As shown in FIGS. 9-10, mold 34 includes cavity 35 and block 40. In some embodiments, block 40 includes a generally M-shaped component for forming the locking feature 14 of slider 10 described above. Mold 34 also includes cores 36 that create locking feature 14 of slider 10 when mold 34 is closed and the cores 36 move towards one another (FIG. 11).

Figure 13:
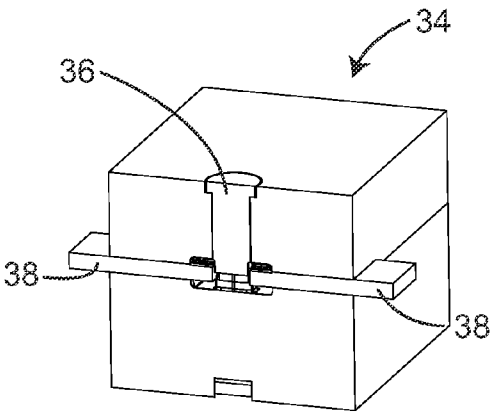
Figure 14:
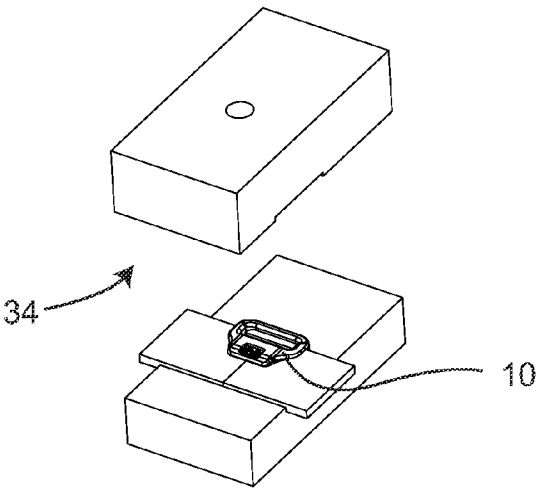
Figure 12:
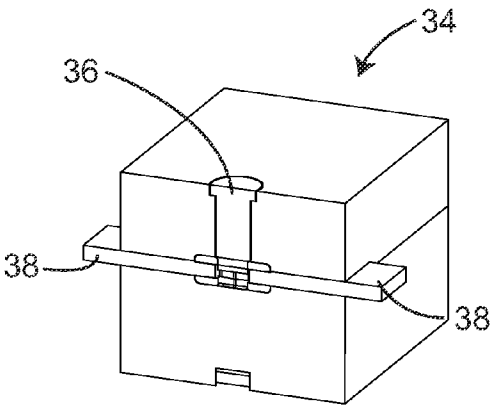

Mold 34 also includes slides 38 that move towards one another in a direction perpendicular to the movement of cores 36 such that slides 38 engage cores 36 (FIG. 12). As shown in FIG. 9, slides 38 are configured so that they form opening 26 and channel 20 of slider 10, as described above. In this way, when cavity 35 of mold 34 is filled with the selected material (FIG. 13) to form slider 10 (FIG. 14), the positioning and configuration of the cores 36 and slides 38 create opening 26 and channel 20 of formed slider 10.

The foregoing is provided for purposes of illustration and disclosure of embodiments of the invention. It will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

For example, any type of slider 10 may be used in embodiments of the invention, including sliders made from various materials. The shape and/or size of slider 10 may be customized to meet customer requirements, including providing a slider 10 where the locking feature 14 is not exposed and/or where the distal portion 12 and/or opening 13 of slider 10 are of a different size and/or shape than the ones described herein. The zipper component 28 may be any type of zipper, including but not limited to water-repellant zippers or non-water-repellant zippers. The zippers may be of any size, including but not limited to traditional No. 5 or No. 10 zippers. Changing the type and size of zipper component 28 may result in changes to the dimensions of the slider 10, such as changing the size and shape of the locking feature 14 so that it is dimensioned to cooperate with the coils 30 of zipper component 28, as described above.

The invention claimed is:

1. A slider comprising:

a channel dimensioned to receive at least partially a plurality of coils of a zipper component;

a locking feature that is structurally integral with the slider, the locking feature having two angled portions and a bottom component positioned between the two angled portions and dimensioned to fit between the coils, wherein at least a portion of the locking feature is positioned within the channel to interact with the coils of the zipper component, and wherein the locking feature is configured so that, when sufficient force is applied to the slider in a first direction along the length of the zipper component, the locking feature allows the slider to move in the first direction along the length of the zipper component, and when sufficient force is applied to the slider in a second direction opposite to the first direction along the length of the zipper component, the locking feature allows the slider to move in the second direction along the length of the zipper component, wherein when the bottom component of the locking feature is received between the coils of the zipper component, a first of the two angled portions contacts one of the coils of the zipper component and a second of the two angled portions contacts an adjacent one of the coils of the zipper component to restrict the movement of the slider in both the first and second directions along the length of the zipper component until the sufficient force is applied to the slider in the first or second direction along the length of the zipper component, and wherein the two angled portions are positioned such that the two angled portions are arranged along the length of the zipper component when the slider is attached to the zipper component.

2. The slider of claim 1, wherein the locking feature is positioned within the channel of the slider so that the locking feature only contacts the coils of the zipper component when the coils of the zipper component are positioned within the channel of the slider.

3. The slider of claim 1, wherein the locking feature is configured so that the bottom component and the two angled portions are the only portions of the locking feature that come in contact with the coils of the zipper component when the coils are received within the channel of the slider.

4. The slider of claim 1, wherein the coils of the zipper component are not perpendicular to at least a portion of the bottom component of the locking feature when the coils of the zipper component are positioned within the channel of the slider.

5. The slider of claim 1, wherein the locking feature is dimensioned so that the locking feature does not contact a tape portion of the zipper component when the coils of the zipper component are positioned within the channel of the slider.

6. The slider of claim 1, wherein the locking feature further comprises a top component that does not contact the coils of the zipper component when the coils are positioned within the channel of the slider.

7. The slider of claim 1, further defining an opening configured to receive at least part of a tape portion of the zipper component.

8. A slider assembly comprising:

a slider comprising:

a distal portion having a first opening;

a channel configured to receive at least partially at least some of a plurality of coils of a zipper component;

a locking feature at least a portion of which is positioned within the channel to engage at least some of the plurality of coils, the locking feature comprising an engaging portion positioned between two angled portions and two upper spacer portions;

a second opening configured to receive at least part of a tape portion of the zipper component, wherein the channel is connected to the second opening and the second opening is located opposite the distal portion, wherein the locking feature is configured so that, when sufficient force is applied to the slider in a first direction along the length of the zipper component, the locking feature allows the slider to move in the first direction along the length of the zipper component, and when sufficient force is applied to the slider in a second direction opposite to the first direction along the length of the zipper component, the locking feature allows the slider to move in the second direction along the length of the zipper component, wherein the engaging portion of the locking feature is dimensioned to fit between at least some of the plurality of coils and a first of the two angled portions is dimensioned to contact one of the coils of the zipper component and a second of the two angled portions is dimensioned to contact an adjacent one of the coils of the zipper component to prevent the movement of the slider in both the first and second directions along the length of the zipper component when the engaging portion is positioned between two of the plurality of coils unless the sufficient force is applied to the slider in the first or second direction along the length of the zipper component, wherein the slider and the locking feature are structurally integral so that the slider and the locking feature form a single component, and wherein the two angled portions are positioned such that the two angled portions are arranged along the length of the zipper component when the slider is attached to the zipper component.

9. The slider assembly of claim 8, further comprising the zipper component.

10. The slider assembly of claim 8, wherein the locking feature is dimensioned and positioned within the slider so that the locking feature does not contact the tape portion of the zipper component when at least some of the plurality of coils of the zipper component are positioned within the channel of the slider.

11. The slider assembly of claim 8, wherein the upper spacer portion of the locking feature is spaced apart from the coils of the zipper component when at least some of the coils are positioned within the channel of the slider.

12. The slider assembly of claim 8, wherein friction generated between the two angled portions of the locking feature and the coils of the zipper component restricts the movement of the slider in both the first and second directions along the length of the zipper component.

* * * * *